US006841247B2

(12) United States Patent
Blackwell et al.

(10) Patent No.: US 6,841,247 B2
(45) Date of Patent: Jan. 11, 2005

(54) FIBERS HAVING IMPROVED DULLNESS AND PRODUCTS CONTAINING THE SAME

(75) Inventors: Robert H. Blackwell, Anderson, SC (US); Donald E. Wright, Anderson, SC (US); Albert R. Moorhead, Anderson, SC (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/602,411

(22) Filed: Jun. 23, 2003

(65) Prior Publication Data

US 2004/0053046 A1 Mar. 18, 2004

Related U.S. Application Data

(60) Provisional application No. 60/403,889, filed on Aug. 16, 2002.

(51) Int. Cl.[7] ..... D01F 6/00

(52) U.S. Cl. ..... 428/397; 428/364

(58) Field of Search ..... 428/364, 376, 428/397

(56) References Cited

U.S. PATENT DOCUMENTS

| | | | | |
|---|---|---|---|---|
| 4,095,317 A | | 6/1978 | Eskridge et al. | 28/221 |
| 5,263,845 A | | 11/1993 | Warren | 425/461 |
| 5,387,469 A | | 2/1995 | Warrant | 428/397 |
| 6,093,491 A | * | 7/2000 | Dugan et al. | 428/397 |

FOREIGN PATENT DOCUMENTS

| | | |
|---|---|---|
| EP | 0595 157 A | 5/1994 |
| JP | 63 159511 A | 11/1998 |

* cited by examiner

*Primary Examiner*—N. Edwards
(74) *Attorney, Agent, or Firm*—Nixon & Vanderhye PC

(57) ABSTRACT

Fibers having a reduced amount of glare are disclosed. Products made therefrom the fibers are also disclosed. Methods of making the fibers and products are further disclosed.

9 Claims, 10 Drawing Sheets

CAPILLARY PROFILE
SCALE: BOX

FIBERS HAVING IMPROVED DULLNESS AND PRODUCTS CONTAINING THE SAME

CROSS-REFERENCE TO RELATED APPLICATION

This application claims the benefit of provisional application Ser. No. 60/403,889, filed Aug. 16, 2002, entitled "Fibers Having Improved Dullness and Products Containing the Same".

BACKGROUND OF THE INVENTION

1. Field of the Invention

The present invention is directed to fibers having a reduced amount of glare, and products made therefrom.

2. Background of the Invention

There is a desire in the carpet industry for fibers having a reduced amount of glare. Carpets, such as carpets used in homes, recreational vehicles, offices, and automobiles, may be exposed to one or more light sources including, but not limited to, sunlight and artificial light. Carpet fibers reflect light and cause an undesirable amount of glare.

What is needed in the art is a fiber having a fiber design, which minimizes the amount of light reflection transmission and glare. What is also needed in the art is a carpet containing fibers, wherein the fibers produce a minimum amount of glare when exposed to natural or artificial light.

SUMMARY OF THE INVENTION

The present invention addresses some of the difficulties associated with minimizing the amount of glare in carpet fibers by the discovery of novel fibers, which minimize the amount of glare when exposed to natural or artificial light. The fibers of the present invention possess fiber cross-sections, which provide unique properties to the fibers and products made therefrom.

Accordingly, the present invention is directed to fibers having a unique cross-section, which provides unique properties to the fiber including, but not limited to, a minimal amount of glare.

The present invention is also directed to a method of making fibers having unique fiber cross-sections and products containing the same.

These and other features and advantages of the present invention will become apparent after a review of the following detailed description of the disclosed embodiments and the appended claims.

DETAILED DESCRIPTION OF THE INVENTION

Figure 1:
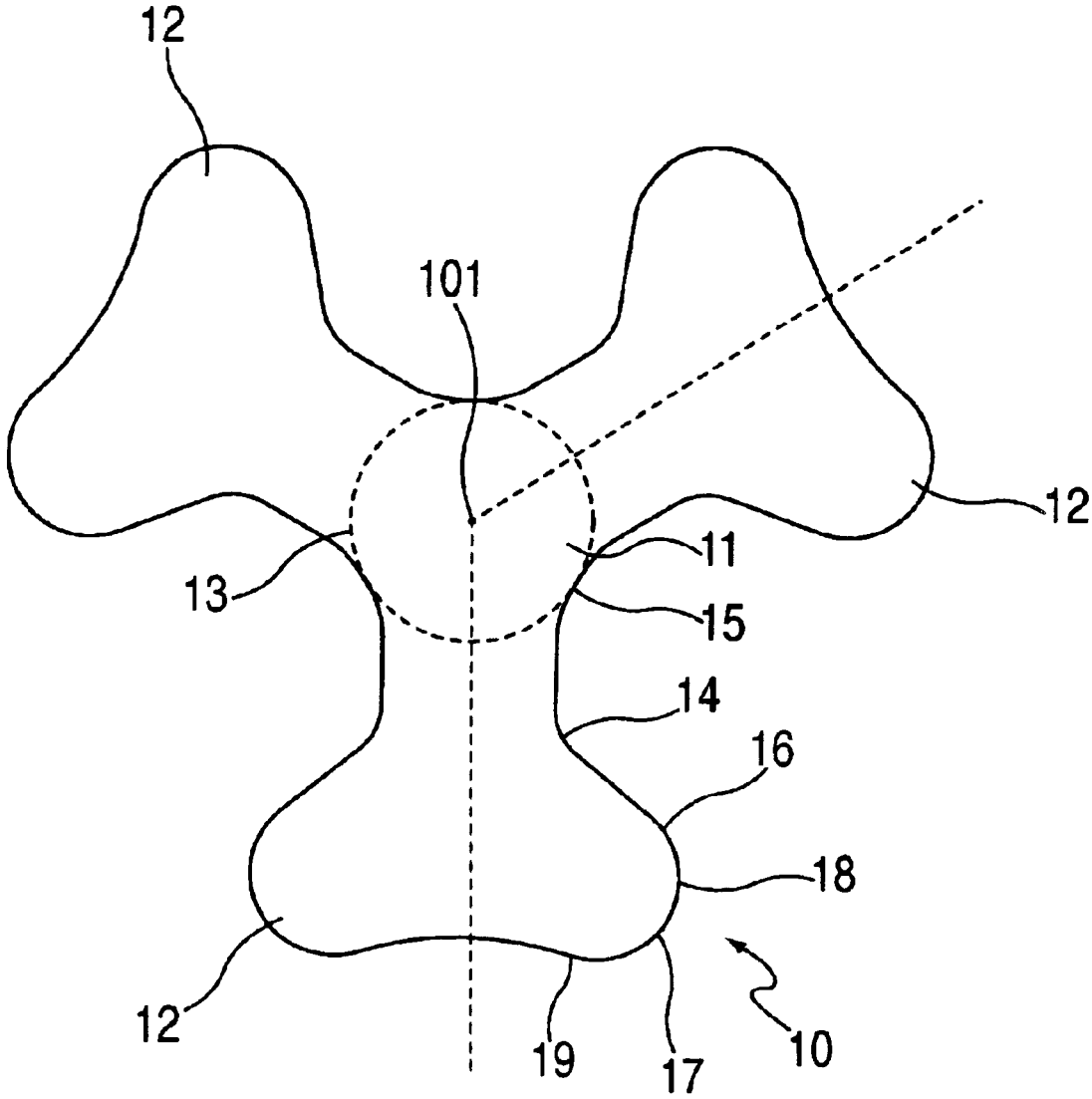
FIG. 1 depicts a fiber cross-section of an exemplary fiber of the proposed invention and the components of the fiber.

To promote an understanding of the principles of the present invention, descriptions of specific embodiments of the invention follow and specific language is used to describe the specific embodiments. It will nevertheless be understood that no limitation of the scope of the invention is intended by the use of specific language. Alterations further modifications, and such further applications of the principles of the present invention discussed are contemplated as would normally occur to one ordinarily skilled in the art to which the invention pertains.

The present invention is directed to fibers having unique fiber cross-section configurations, wherein the fibers possess a minimum amount of glare and a maximum amount of dullness. As used herein, the term "dullness" refers to the resistance of a fiber to reflect natural or artificial light. The present invention is further directed to products containing the above-mentioned fibers, such as carpet tiles and carpet fabrics. The present invention is further directed to methods of making the above-described fibers and products containing the same.

I. Fibers

The fibers of the present invention possess a fiber configuration, which maximizes the amount of dullness of the fiber. The properties and chemical composition of the fibers are discussed below.

A. Fiber Cross-Sectional Configuration

A number of ways may be used to describe the cross-sectional configuration of the fibers of the present invention. One method of describing the cross-sectional configuration of the fibers is by examining the components of the fiber including the central axis, the fiber core, and the lobes of the fiber. As used herein, the term "lobe" refers to fiber extensions radiating from a fiber central core. For example, in FIG. 1, an exemplary fiber cross-sectional configuration 10 is shown having a fiber central axis 101, a fiber central core 11 and three symmetrical lobes 12. An inscribed circle 13 is used to designate central core 11 of fiber 10. As used throughout the description of the present invention, the lobes 12 of a given fiber comprise the cross-sectional area of the fiber outside of inscribed circle 13 (see FIG. 1).

The fibers of the present invention may also be described in terms of the number of concave portions, the number of convex portions, and the number of inflection points along an outer perimeter of a given lobe of the fiber. As used herein, the term "concave portion" is used to describe a portion of the outer perimeter of a lobal cross-section, which forms an arc of curvature wherein the radius of curvature for the arc points away from the fiber lobe. As used herein, the term "convex portion" is used to describe a portion of the outer perimeter of a lobal cross-section, which forms an arc of curvature wherein the radius of the arc points toward the fiber lobe. As used herein, the term "inflection point" is used to describe an intersection between a concave portion and a convex portion of the outer perimeter. As shown in FIG. 1, concave portion 14 extends from point 15 to inflection point 16 along an outer perimeter 17 of the fiber cross-sectional configuration. Convex portion 18 extends from inflection point 16 along perimeter 17 to a second inflection point 19.

The fibers of the present invention desirably comprise two or more lobes extending from and equally spaced along a central core of the fiber. In one desired embodiment of the present invention, the fiber comprises three lobes extending from and equally spaced along a central fiber portion. In a further embodiment of the present invention, the fiber comprises four symmetrical lobes extending from and equally spaced along a central portion of the fiber.

As used herein, the term "equally spaced" refers to the relative positions of the two or more lobes within a 360° path. For example, for a fiber having two equally spaced lobes extending from a fiber central core, the lobes are separated from one another by an angle of about 180°, desirably, 180°±10°, more desirably, 180°±5°, and even more desirably, 180°±1°. For a fiber having three equally spaced lobes extending from a fiber central core, the lobes are separated from one another by an angle of about 120°, desirably, 120°±10°, more desirably, 120°±5°, and even more desirably, 120°±1°. For a fiber having four equally spaced lobes extending from a fiber central core, the lobes are separated from one another by an angle of about 90°, desirably, 90°±10°, more desirably, 90°±5°, and even more desirably, 90°±1°. For more than four lobes, the lobes are desirably equally spaced from one another around a fiber central core by (360°/n), where n is the number of lobes.

The fibers of the present invention possess exceptional dullness properties (i.e., reduced glare) due to the unique structure of the lobes extending from the fiber central core. A cross-sectional examination of each lobe shows a combination of concave portions, convex portions, and inflection points along an outer perimeter of the lobal cross-sectional area. In one desired embodiment of the present invention, each lobe has a substantially similar lobal cross-sectional configuration comprising at least three concave portions, at least two convex portions, and at least four inflection points along an outer periphery of the lobal cross-sectional area. In another desired embodiment of the present invention, each lobe has a substantially similar lobal cross-sectional configuration comprising at least three concave portions, at least three convex portions, and at least five inflection points along an outer perimeter of the lobal cross-sectional area. As used herein, the term "substantially similar lobal cross-sectional configuration" is used to describe lobal cross-sectional configurations, which appear to have an identical combination and sequence of concave portions, convex portions, and inflection points along an outer periphery of the lobal cross-sectional area such that if one lobal cross-sectional configuration is placed on top of another lobal cross-sectional configuration, the outer perimeters of both cross-sections would trace each other. It should be noted that each individual lobe of a given fiber may have one or more imperfections in the cross-sectional configuration. Such imperfections may result in slight differences between adjacent lobes; however, such fibers are also within the scope of the present invention.

In one desired embodiment of the present invention, each lobe contains three concave portions, two convex portions, and four inflection points along an outer periphery of the fiber cross-sectional area. In this desired embodiment, the combination of concave portions, convex portions, and inflection points along the outer perimeter of each lobal cross-sectional area forms a symmetrical pathway such that a lobe-dissecting line extending from a fiber central axis through a central portion of the lobe dissects the lobe into two substantially identical lobal portions on each side of the lobe-dissecting line.

Figure 2:
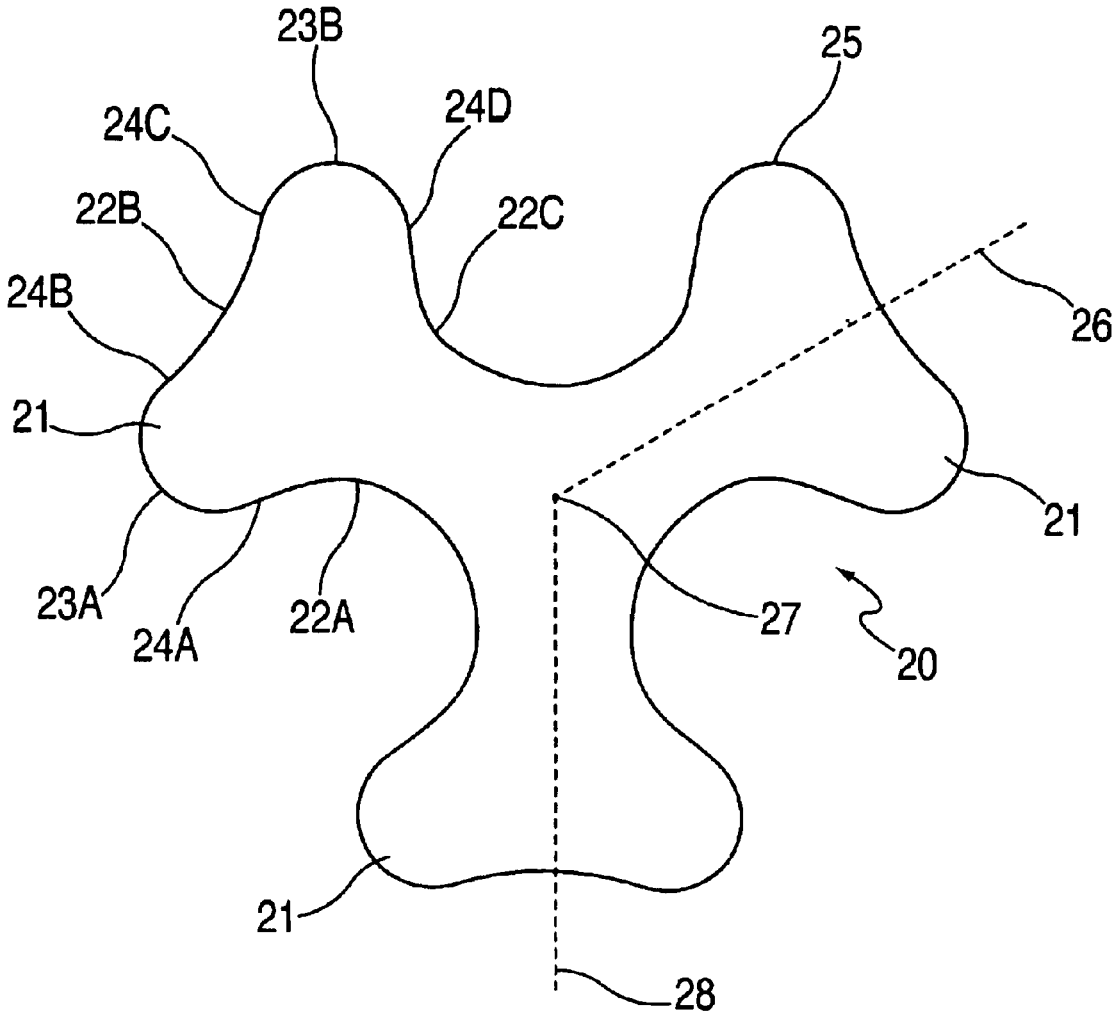
FIG. 2 depicts a fiber cross-section of an exemplary fiber of the present invention having a forked tri-lobal design.

One exemplary fiber of the present invention having such a symmetrical pathway is shown in FIG. 2. The fiber shown in FIG. 2 has what is referred to herein as a "forked tri-lobal" fiber configuration. Each of the lobes 21 of fiber 20 has a substantially identical cross-sectional configuration, which includes concave portions 22A through 22C, convex portions 23A through 23B, and inflection points 24A through 24D. As shown in FIG. 2, the forked tri-lobal fiber configurational is substantially free of any flat surfaces along an outer periphery of the fiber cross-section. In other words, the forked tri-lobal fiber cross-sectional comprises only concave portions, convex portions, and inflection points. In particular, each lobe 21 comprises the following sequence of components: a first concave portion (22A), a first inflection point (24A), a first convex portion (23A), a second inflection point (24B), a second concave portion (23A), a third inflection point (24C), a second convex portion (23B), a fourth inflection point (24D), and a third concave portion (22C). The absence of flat surfaces along an outer periphery of the forked tri-lobal fiber of the present invention enhances the dullness of the fiber when exposed to natural or artificial light.

It should be understood that other forked multi-lobal fibers are within the scope of the present invention. For example, a forked tetra-lobal fiber of the present invention comprises four equally spaced lobes along a central fiber core, wherein each lobe has a lobal cross-sectional configuration substantially similar to lobes 21 shown in FIG. 2.

In the forked multi-lobal fibers of the present invention, the concave portions, convex portions, and inflection points form a symmetrical outer periphery 25, which is symmetrical along a line 26 extending from central axis 27 of fiber 20 through a central portion of lobe 21 as shown in FIG. 2. Furthermore, it should be understood that it is desirable for each lobe 21 to be equally spaced from one another along central axis 27. In other words, for a tri-lobal fiber of the present invention, it is desirable for the angle between line 26 and line 28 as shown in FIG. 2 to be about 120°. For tetra-lobal fibers of the present invention, it is desirable for the angle between each lobe to be about 90°.

Figure 2A:
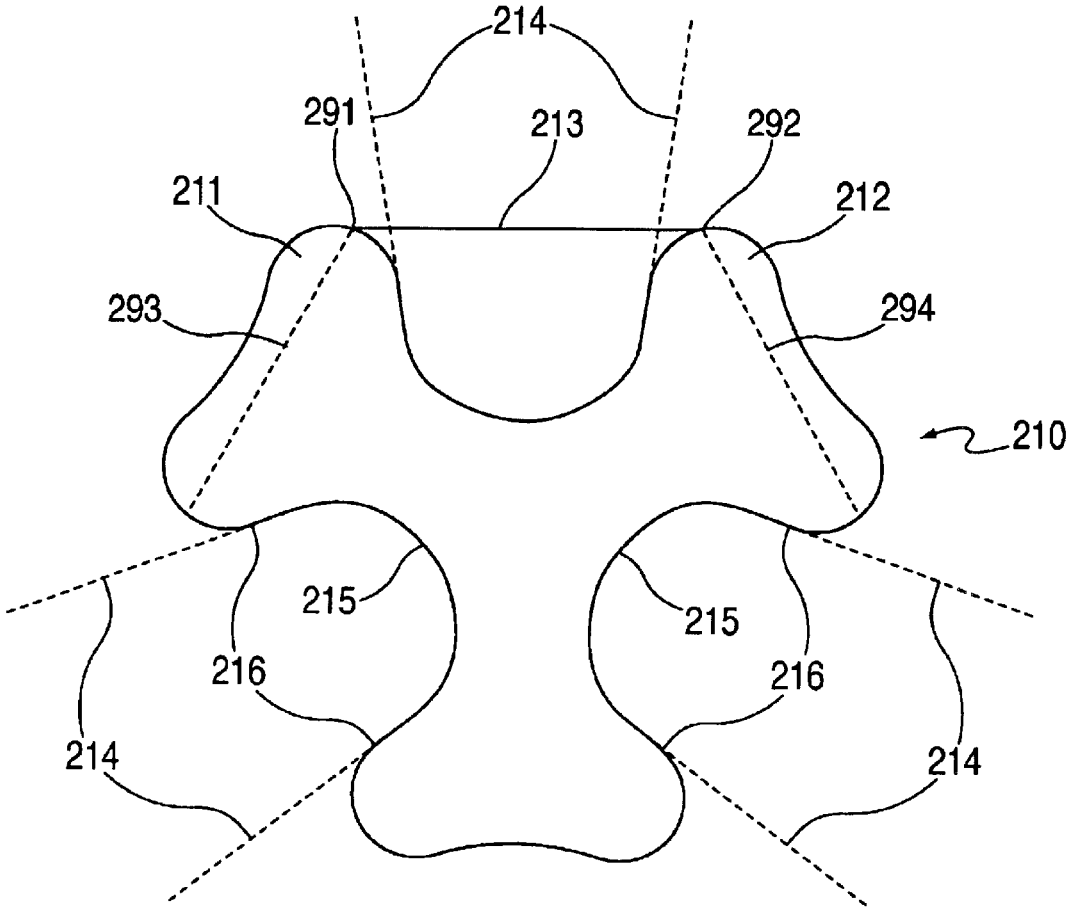
FIG. 2A depicts features of a forked multi-lobal design relative to the orientation of lobes to one another.

A further desirable characteristic of the forked multi-lobal fibers of the present invention is the orientation of the lobe tips to one another. As shown in FIG. 2A, the maximum distance between adjacent lobes 211 and 212 is along line 213 between point 291 on lobe 211 and point 292 on adjacent lobe 212. Desirably, the maximum distance between adjacent lobes in the forked multi-lobal fibers of the present invention is measurable at a location near the maximum width of each lobe (e.g., point 291 on lobe 211 and point 292 on adjacent lobe 212 are both located on their respective lobe at about a maximum width of each lobe, the maximum width of each lobe being designated by dash lines 293 and 294). Also, dotted line 214 represent lines extending from concave portions 215 between adjacent lobes. Dotted lines 214 extend from inflection points 216. In the forked multi-lobal fibers of the present invention, dotted lines 214 extending from inflection points 216 between adjacent lobes are desirably parallel to one another or divergent relative to one another (i.e., the lines do not cross one another). This particular characteristic of the forked multi-lobal fibers of the present invention also provides improved dullness (i.e., reduced glare).

In a further desired embodiment of the present invention, each lobe contains at least three concave portions, at least three convex portions, and at least five inflection points along an outer periphery of the fiber cross-sectional area. In this desired embodiment, the combination of concave portions, convex portions, and inflection points along the outer perimeter of each lobal cross-sectional area forms a pathway such that a lobe-dissecting line extending outward from a fiber central axis through the lobe moves in a serpentine-like pathway to a tip of the lobe. Further, the tip of the lobe is off-center from a straight line extending outward from a fiber central axis in a direction, which dissects a portion of lobe adjacent to the fiber central core.

Figure 3A:
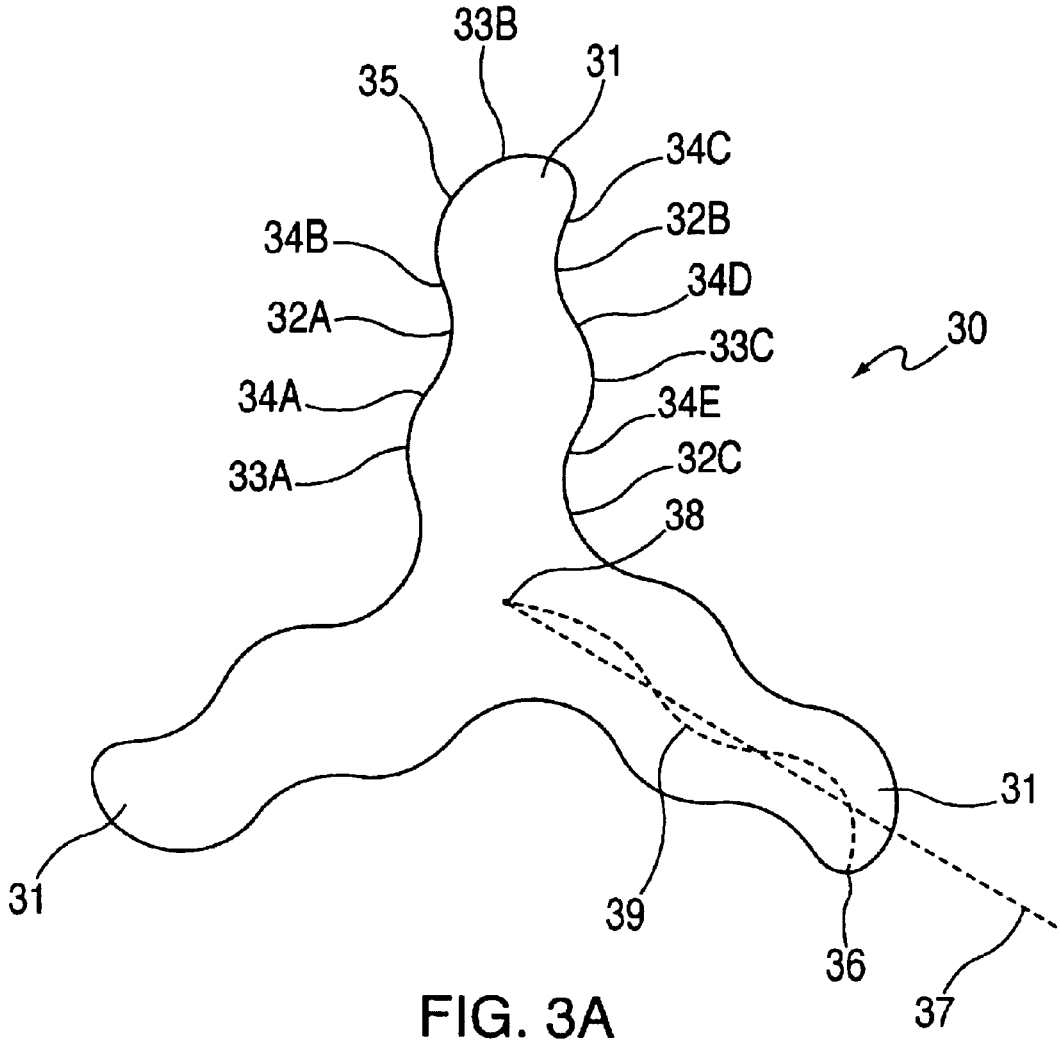
FIG. 3A depicts a fiber cross-section of an exemplary fiber of the present invention having a serpentine tri-lobal design.

One exemplary fiber of the present invention having such a serpentine-like structure is shown in FIG. 3A. The fiber shown in FIG. 3A has what is referred to herein as a "serpentine tri-lobal" fiber cross-sectional configuration. Each lobe 31 of the serpentine tri-lobal fiber configuration 30 comprises concave portions 32A through 32C, convex portions 33A through 33C, and inflection points 34A through 34E. Like the forked tri-lobal fiber cross-sectional configuration, the serpentine tri-lobal fiber cross-sectional configuration is substantially free of flat surfaces along outer periphery 35 of lobes 31. Further, like the forked multi-lobal fibers described above, serpentine multi-lobal fibers having two or more substantially similar serpentine lobes extending from a central fiber core are also within the scope of the present invention.

Each lobe of a serpentine multi-lobal fiber of the present invention possesses a unique combination of concave portions, convex portions, and inflection points along an outer perimeter of the lobal cross-section. In one embodiment of the present invention (as shown in FIG. 3A), each lobe of the serpentine multi-lobal fiber has the following sequence of components, starting from a left-hand side of the lobe when observing a cross-sectional configuration of the lobe: a first convex portion (33A), a first inflection point (34A), a first concave portion (32A), a second inflection point (34B), a second convex portion (33B), a third inflection point (34C), a second concave portion (32B), a fourth inflection point (34D), a third convex portion (33C), a fifth inflection point (34E), and a third concave portion (32C). The serpentine design may further include additional concave portions, convex portions, and inflection points as long as the serpentine-like design remains. An interesting characteristic of the serpentine design is that the thickness of the lobe either remains the same or narrows as the lobe extends from a central fiber core. In one embodiment of the present invention, the thickness of each lobe gradually narrows in thickness as the lobe gets further away from a fiber center core. As shown in FIG. 3A, a lobe-dissecting line 39 extending outward from fiber central axis 38 through lobe 31 moves in a serpentine-like pathway to tip 36 of lobe 31. The tip 36 of each lobe 31 is off-center from a line 37, which extends outward from central fiber axis 38 through a central portion of lobe 31.

In yet a further desired embodiment of the present invention, each lobe contains at least three concave portions, at least three convex portions, and at least four inflection points along an outer periphery of the fiber cross-sectional area. In this desired embodiment, the combination of concave portions, convex portions, and inflection points along the outer perimeter of each lobal cross-sectional area forms a pathway such that a lobe-dissecting line extending outward from a fiber central axis through the lobe moves in an S-shaped pathway to a tip of the lobe. Further, the tip of the lobe is off-center from a straight line extending outward from a fiber central axis in a direction, which dissects a portion of lobe adjacent to the fiber central core.

Figure 3B:
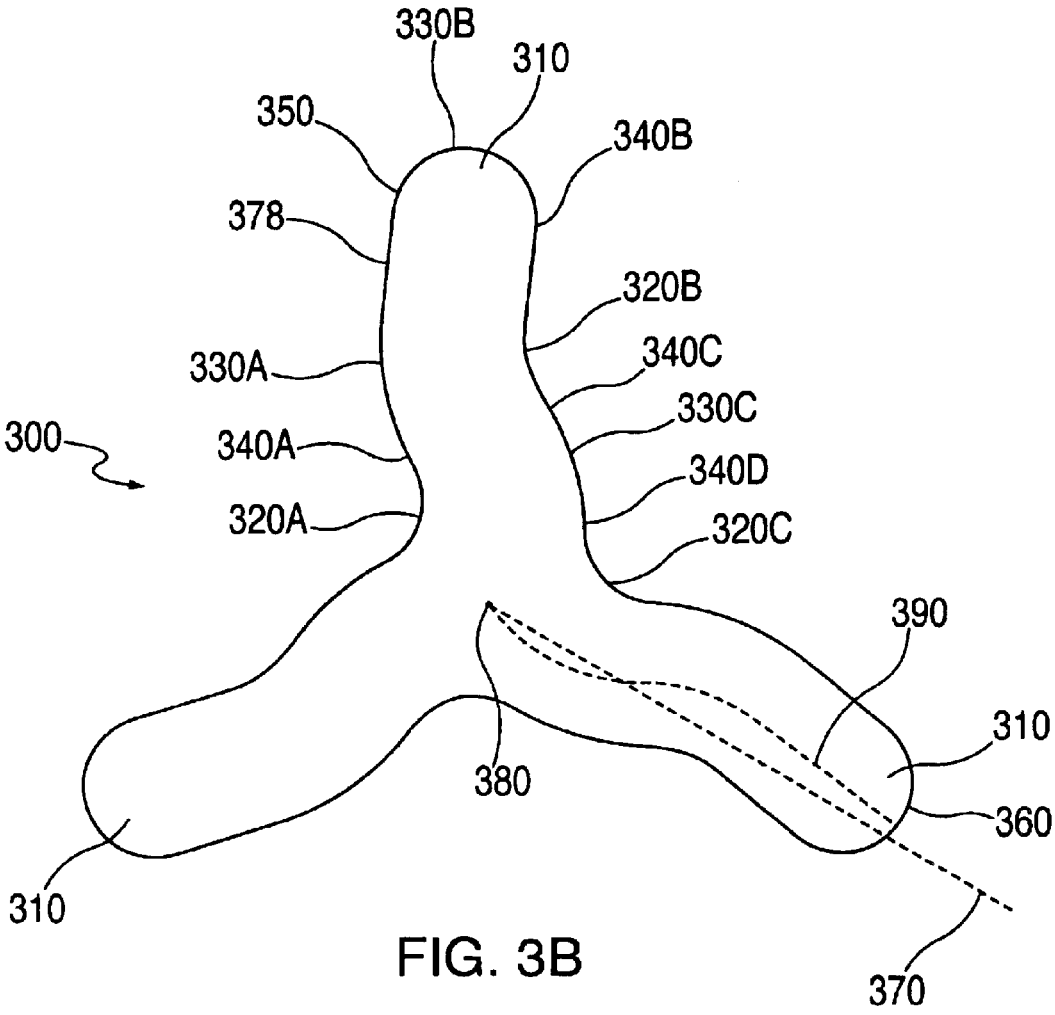
FIG. 3B depicts a fiber cross-section of an exemplary fiber of the present invention having an "elongated S" tri-lobal design.

One exemplary fiber of the present invention having lobes with such a S-shaped structure is shown in FIG. 3B. The fiber shown in FIG. 3B has what is referred to herein as an "elongated S" tri-lobal fiber cross-sectional configuration. Each lobe 310 of the elongated S tri-lobal fiber configuration 300 comprises concave portions 320A through 320C, convex portions 330A through 330C, and inflection points 340A through 340D. Unlike the forked tri-lobal fiber cross-sectional configuration and the serpentine tri-lobal fiber cross-sectional configuration described above, the elongated S tri-lobal fiber configuration may have a substantially flat surface 378 along outer periphery 350 of lobes 310. Desirably, substantially flat surface 378 along outer periphery 350 of lobes 310 has a length of from about 130 $\mu$m to about 300 $\mu$m, more desirably, from about 180 $\mu$m to about 280 $\mu$m. It should be noted that the portion of the fiber lobe along surface 378 as shown in FIG. 3B may have a concave portion and one or more inflection points therein. In some cases, the fiber lobe along surface 378 does contain a concave portion and two inflection points. Further, like the forked multi-lobal fibers described above, elongated S tri-lobal fibers having two or more substantially similar elongated S lobes extending from a central fiber core are also within the scope of the present invention.

Each lobe of an elongated S multi-lobal fiber of the present invention possesses a unique combination of concave portions, convex portions, and inflection points along an outer perimeter of the lobal cross-section. In one embodiment of the present invention (as shown in FIG. 3B), each lobe of the elongated S multi-lobal fiber has the following sequence of components, starting from a left-hand side of the lobe when observing a cross-sectional configuration of the lobe: a first concave portion (320A), a first inflection point (340A), a first convex portion (330A), a substantially flat section (378), a second convex portion (330B), a second inflection point (340B), a second concave portion (320B), a third inflection point (340C), a third convex portion (330C), a fourth inflection point (340D), and a third concave portion (320C). The elongated S design may further include additional concave portions, convex portions, and inflection points as long as the elongated S design remains.

In a further embodiment of the present invention, substantially flat section (378) contains a concave portion and two inflection points. The resulting elongated S multi-lobal fiber contains lobes, wherein each lobe of the fiber has the following sequence of components, starting from a left-hand side of the lobe when observing a cross-sectional configuration of the lobe a first concave portion (320A), a first inflection point (340A), a first convex portion (330A), a second inflection point (not shown), a second concave portion (not shown), a third inflection point (not shown), a second convex portion (330B), a fourth inflection point (340B), a third concave portion (320B), a fifth inflection point (340C), a third convex portion (330C), a sixth inflection point (340D), and a fourth concave portion (320C).

An interesting characteristic of the elongated S design is that the thickness of the lobe either remains substantially the same as the lobe extends from a central fiber core. In one embodiment of the present invention, the thickness of each lobe gradually narrows in thickness as the lobe approaches the tip of the lobe, but then gradually expands (i.e., widens) to form a bulb on the tip of the lobe. As shown in FIG. 3B, a lobe-dissecting line 390 extending outward from fiber central axis 380 through lobe 310 moves in an S-shaped pathway to tip 360 of lobe 310. The tip 360 of each lobe 310 is off-center from a line 370, which extends outward from central fiber axis 380 through a central portion of lobe 310.

B. Fiber Dimensions

The fibers of the present invention may have dimensions, which vary depending on a number of factors including, but not limited to, fiber materials such as polymer type and additives; processing conditions such as spinning temperature, melt viscosity of the polymer, and quench medium; and end use. Typically, the fibers of the present invention have dimensions as shown in Table 1 below.

TABLE 1

Fiber Dimensions

| Fiber Dimension | Range | Desired Range |
|---|---|---|
| Fiber Core Thickness | about 10 to about 30 μm | about 15 to about 24 μm |
| Fiber Width | about 50 to about 120 μm | about 80 to about 100 μm |
| Average Thickness of Lobe Component Proximate to Fiber Core | about 8 to about 50 μm | about 8 to about 35 μm |
| Length of Lobe Component | about 15 to about 55 μm | about 21 to about 48 μm |

Figure 4A:
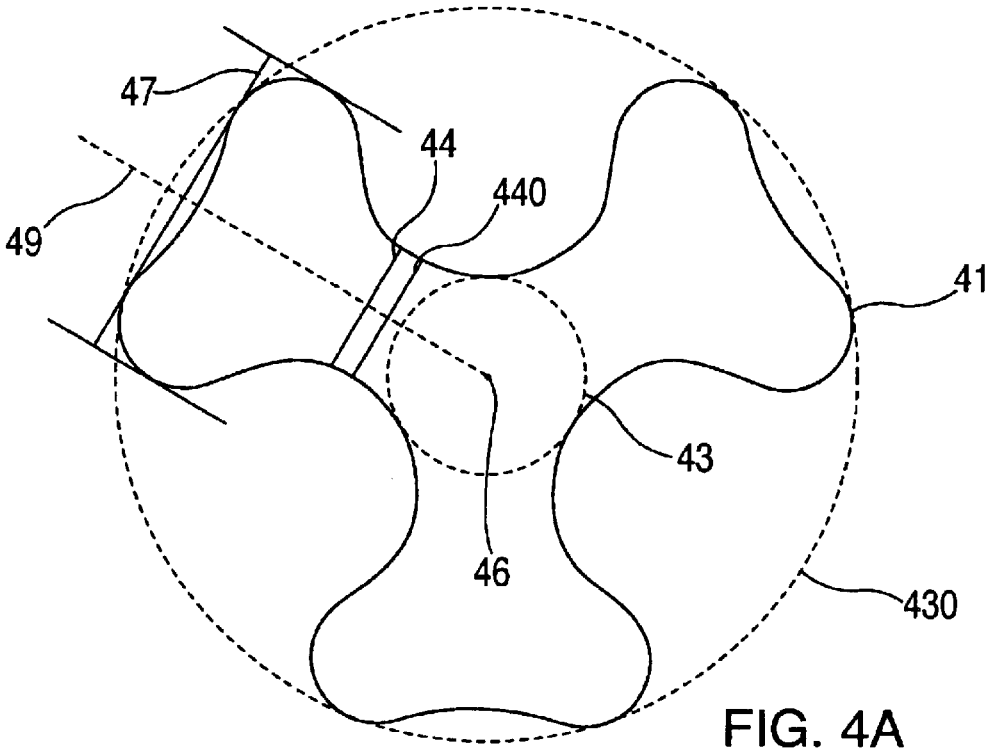
FIG. 4A depicts a fiber cross-section of an exemplary forked tri-lobal fiber and its dimensions.
Figure 4B:
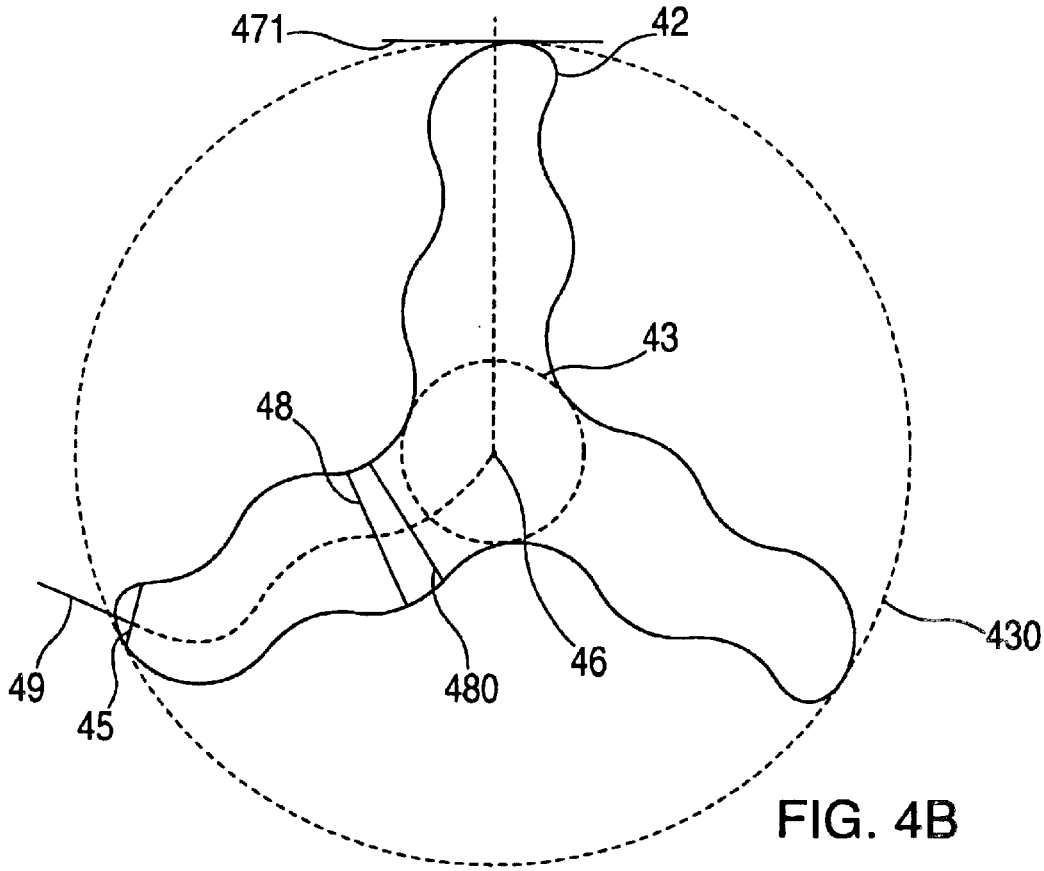
FIG. 4B depicts a fiber cross-section of an exemplary serpentine tri-lobal fiber and its dimensions.
Figure 4C:
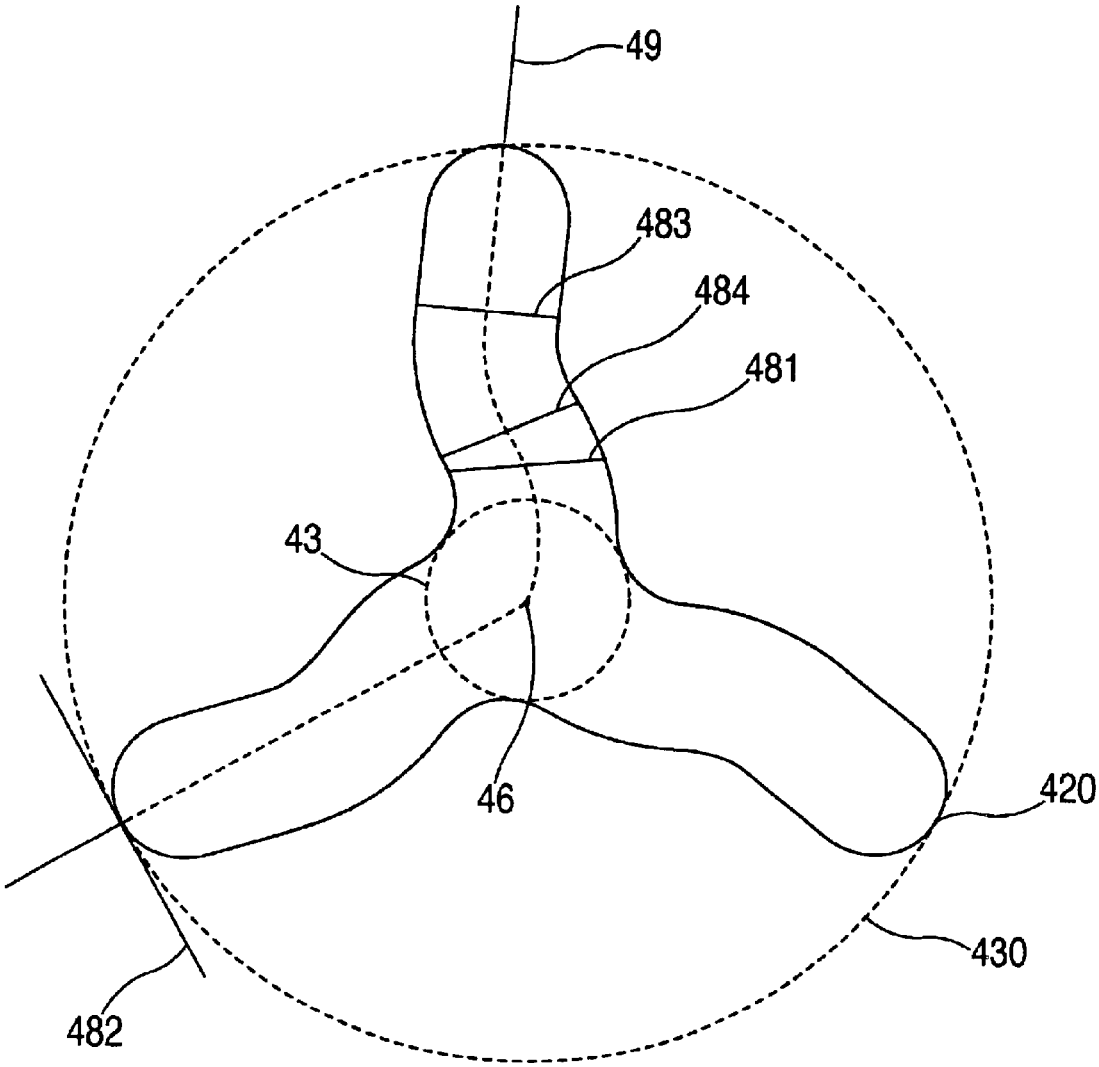
FIG. 4C depicts a fiber cross-section of an exemplary elongated S tri-lobal fiber and its dimensions.

Each of the fiber measurements given above in Table 1 may be fully understood with reference to FIGS. 4A, 4B and 4C. As used herein, "fiber core thickness" is used to refer to the diameter of an inscribed circle 43 within fiber cross-sectional areas 41, 42 and 420 as shown in FIGS. 4A, 4B and 4C respectively. As used herein, "fiber width" is used to refer to the diameter of a circumscribed circle 430 surrounding fiber cross-sectional areas 41, 42 and 420 as shown in FIGS. 4A, 4B and 4C respectively. As used herein, "average thickness of lobe component proximate to fiber core" refers to a length represented by lines 440, 480 and 481 as shown in FIGS. 4A, 4B and 4C respectively, wherein each line is perpendicular to lobe-dissecting line 49. As used herein, "length of lobe" refers to a length extending from central fiber axis 46 to line 47 in FIG. 4A, line 471 in 4B, and line 482 in 4C.

Desired fiber dimensions for forked multi-lobal fibers of the present invention are shown in Table 2 below. As used herein, "minimum thickness of lobe component" ($t_{min}$) refers to a minimum thickness as shown by lines 44, 45 and 483 in FIGS. 4A, 4B and 4C respectively, which represents a length that is perpendicular to a lobe-dissecting line 49 extending from fiber central axis 46 through a central portion of a lobe. As used herein, "maximum thickness of lobe component" ($t_{max}$) refers to a maximum length represented by lines 47, 48 and 484 in FIGS. 4A, 4B and 4C respectively, which is also perpendicular to lobe-dissecting line 49.

TABLE 2

Fiber Dimensions For Forked Multi-Lobal Fibers

| Fiber Dimension | Desired Range |
|---|---|
| Fiber Core Thickness | about 15.0 μm to about 18.0 μm |
| Minimum Thickness of Lobe Component, $t_{min}$ | about 9.0 μm to about 15.0 μm |
| Maximum Thickness of Lobe Component, $t_{max}$ | about 23.0 μm to about 35.0 μm |
| Length of Lobe Component | about 21.5 μm to about 33.5 μm |

Desired fiber dimensions for serpentine multi-lobal fibers of the present invention are shown in Table 3 below.

TABLE 3

Fiber Dimensions For Serpentine Multi-Lobal Fibers

| Fiber Dimension | Desired Range |
|---|---|
| Fiber Core Thickness | about 18 μm to about 22 μm |
| Minimum Thickness of Lobe Component, $t_{min}$ | about 8 μm to about 12 μm |
| Maximum Thickness of Lobe Component, $t_{max}$ | about 13 μm to about 19 μm |
| Length of Lobe Component | about 43 μm to about 48 μm |

Desired fiber dimensions for elongated S multi-lobal fibers of the present invention are shown in Table 4 below.

TABLE 4

Fiber Dimensions For Elongated S Multi-Lobal Fibers

| Fiber Dimension | Desired Range |
|---|---|
| Fiber Core Thickness | about 19 μm to about 24 μm |
| Minimum Thickness of Lobe Component, $t_{min}$ | about 13 μm to about 18 μm |
| Maximum Thickness of Lobe Component, $t_{max}$ | about 13 μm to about 18 μm |
| Length of Lobe Component | about 30 μm to about 40 μm |

The fibers of the present invention may also be characterized by their modification ratio. As used herein, the term "modification ratio" (MR) refers to the ratio of (a) the radius of a circle, which circumscribes the filament cross-sectional area to (b) the radius of the largest circle, which may be inscribed within the filament cross-section. Desirably, the modification ratio of the fibers of the present invention is greater than about 4.0, more desirably, greater than about 4.1.

The fibers of the present invention may be further characterized by their denier per filament (dpf). Denier per filament is defined as the weight in grams of a single filament with a length of 9000 meters. Desirably, the fibers of the present invention have a denier per filament ranging from about 3 to about 75 dpf. More desirably, the fibers of the present invention have a denier per filament ranging from about 10 to about 38 dpf. Even more desirably, the fibers of the present invention have a denier per filament ranging from about 13 to about 19 dpf.

C. Fiber Composition

The fibers of the present invention may be prepared from a variety of thermoplastic polymeric materials. Suitable thermoplastic polymeric materials include, but are not limited to, polyamides, polyesters, polyolefins, or a combination thereof. Desirably, the fibers of the present invention comprise one or more polyamides selected from nylon 6, nylon 6/6, nylon 6/9, nylon 6/10, nylon 6/12, nylon 11, nylon 12, copolymers thereof and mixtures thereof. More desirably, the fibers of the present invention comprise monocomponent fibers comprising a single polyamide selected from nylon 6 and nylon 6/6. Suitable polyesters include, but are not limited to, polyethylene terephthalate.

The fibers of the present invention may contain one or more additives blended into the thermoplastic polymeric material. Suitable additives include, but are not limited to, lubricants, nucleating agents, antioxidants, ultraviolet light stabilizers, pigments, dyes, antistatic agents, soil resists, stain resists, antimicrobial agents, and flame retardants. When present, the one or more additives are present in an amount of up to about 15 weight percent (wt %) based on a total weight of the thermoplastic polymeric material.

II. Method of Making Fibers

Figure 5:
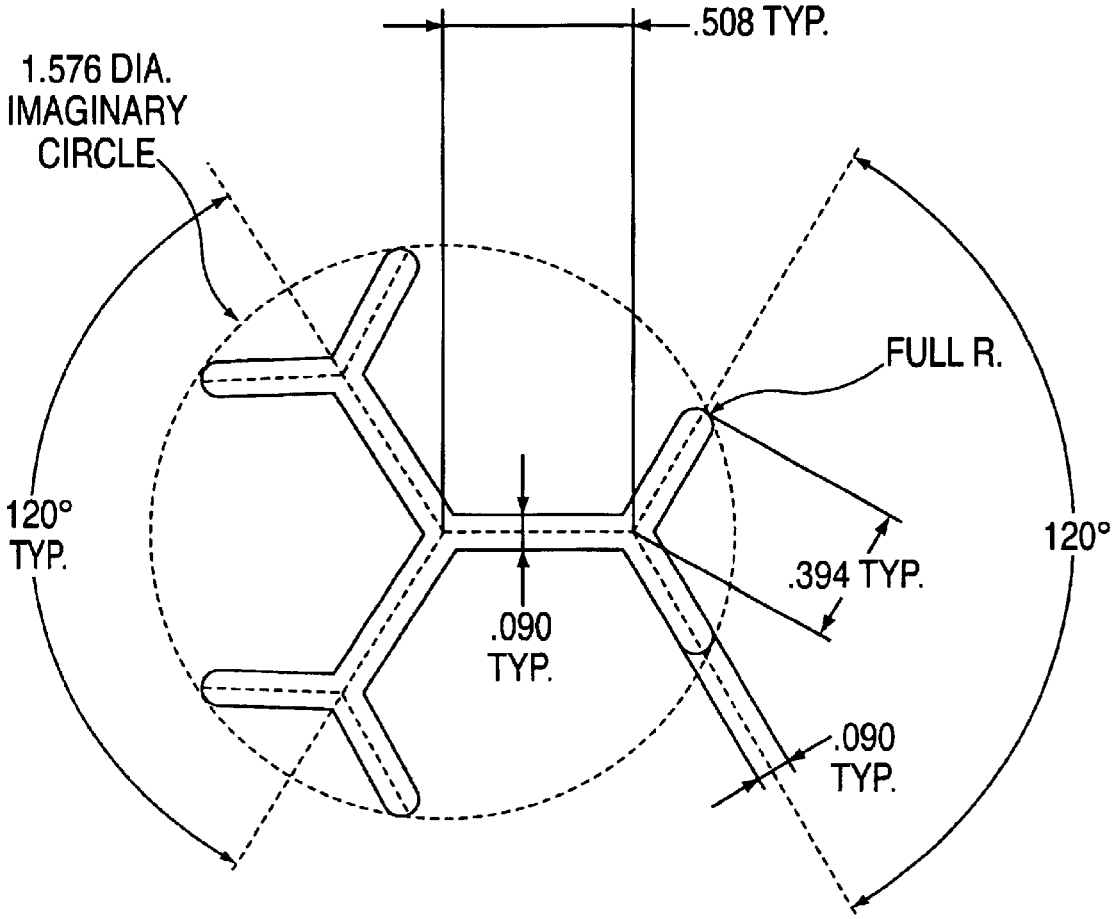
FIG. 5 depicts a capillary design for forming the exemplary forked tri-lobal fiber shown in FIG. 2.
Figure 6:
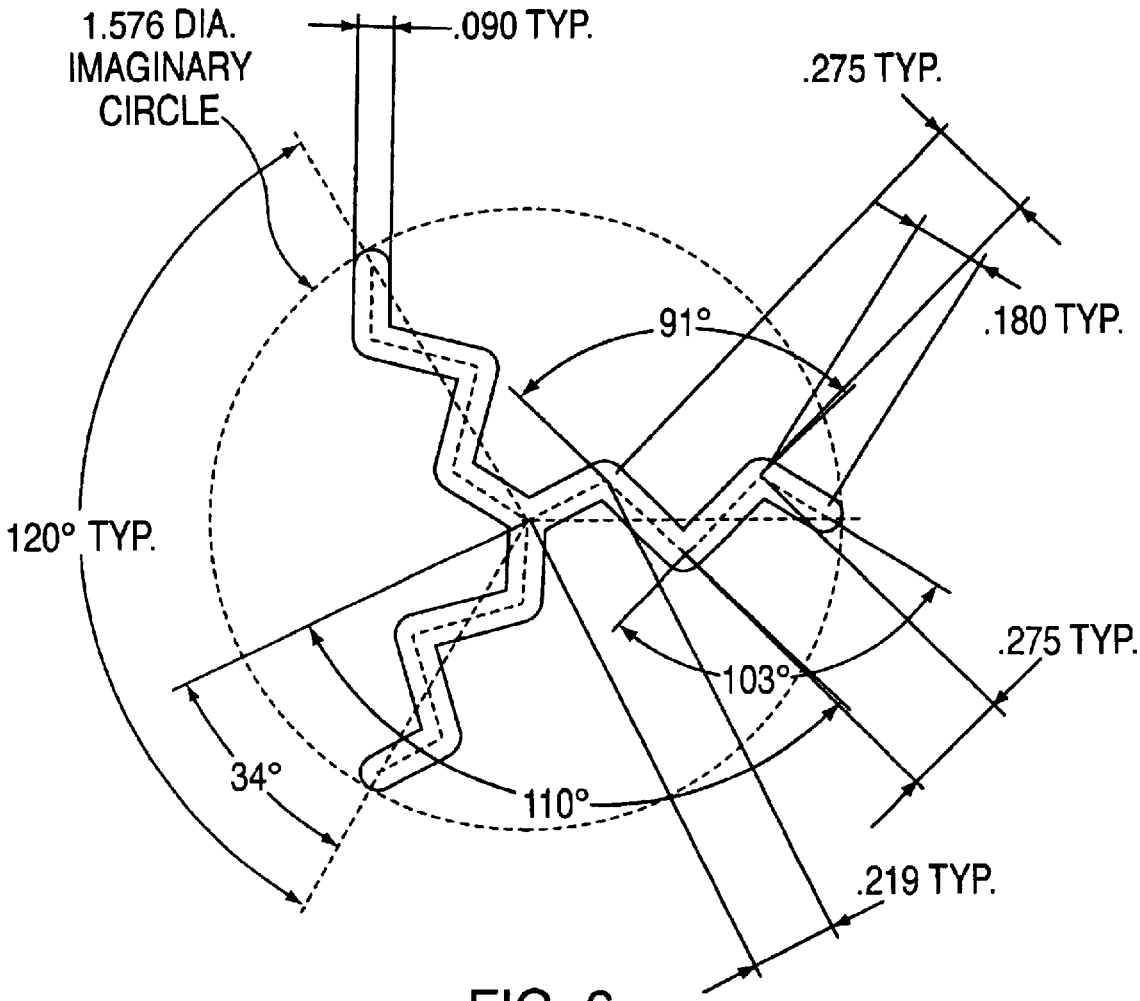
FIG. 6 depicts a capillary design for forming the exemplary serpentine tri-lobal fiber shown in FIG. 3A.
Figure 7:
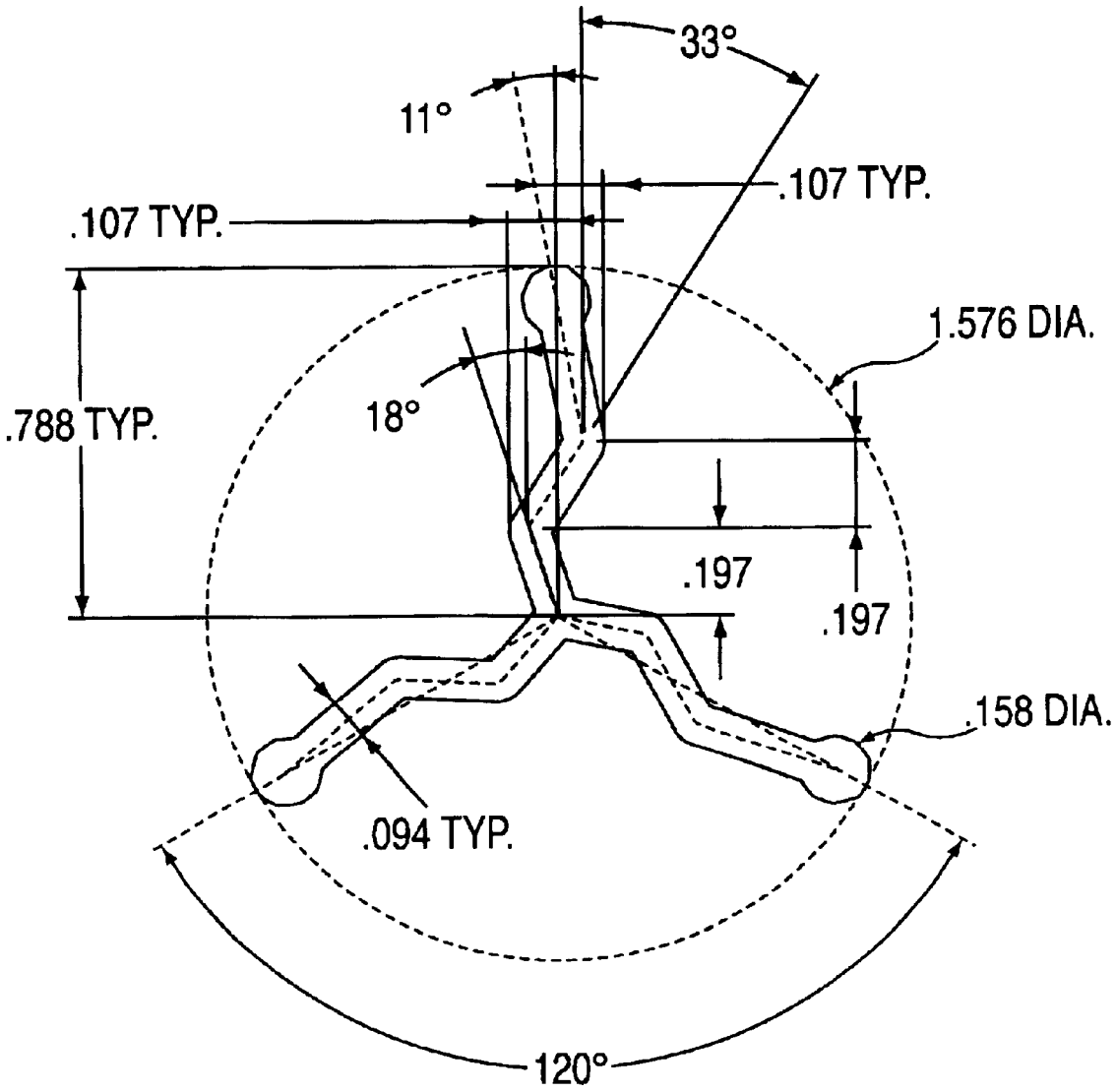
FIG. 7 depicts a capillary design for forming the exemplary elongated S tri-lobal fiber shown in FIG. 3B.

The present invention is further directed to methods of making the above-described fibers. Conventional melt-extrusion processes may be used to produce the fibers of the present invention using capillary configurations, which result in fibers having a desired cross-sectional configuration as described above. Suitable capillary configurations include, but are not limited to, the capillary configurations as shown in FIGS. 5, 6 and 7.

In one method of the present invention, polymer is fed into an extruder in the form of chips or granules. The polymer is melted and directed via jacketed DOWTHERM® (Dow Chemical, Midland Mich.) heated polymer distribution lines to a spinning lead. The polymer melt is then metered by a high efficiency gear pump to a spin pack assembly and extruded through a spinnerette with capillaries having a capillary configuration such as those shown in FIGS. 5, 6 and 7. The polymer is extruded through the capillary of the spinnerette plate to form a fiber having a desired fiber cross-sectional configuration as described above.

Spinnerette plates used in the method of the present invention typically have from about 5 to about 300 openings in the form of capillaries as described above, desirably from about 10 to about 200 openings. The extruded fibers are drawn and quenched, for example, with air in order to orient and solidify the fibers.

The fibers may then be treated with a finish comprising a lubricating oil or mixture of oils and antistatic agents. The fibers are then typically combined to form a yarn bundle, which is then wound on a suitable package.

In a subsequent step, the yarn may be drawn and texturized to form a bulked continuous filament (BCF) yarn suitable for tufting into carpets. One desired technique involves combining the extruded or as-spun filaments into a yarn, then drawing, texturizing and winding a package, all in a single step. This one-step method of making BCF is referred to in the trade as spin-draw-texturing.

The fibers of the present invention may be made using any of the methods disclosed in U.S. Pat. Nos. 5,263,845 and 5,387,469, the disclosure of both of which is herein incorporated by reference.

Fibers of the present invention for use in carpet manufacturing typically have fiber deniers (denier being the weight in grams of a single filament with a length of 9000 meters) in the range of about 3 to 75 denier/filament (dpf). Desirably, the denier range for carpet fibers is from about 6 to 35 dpf. The BCF yams may proceed through various processing steps well known to those of ordinary skilled in the art. The fibers of the present invention are particularly useful in the manufacture of carpets for floor covering applications.

To produce carpets for floor covering applications, the BCF yams are generally tufted into a pliable primary backing. Primary backing materials may include, but are not limited to, conventional woven jute, woven polypropylene, cellulosic nonwovens and nonwovens of nylon, polyester, and polypropylene. The primary backing may then be coated with a suitable latex material such as a conventional styrene-butadiene latex, a vinylidene chloride polymer, or a vinyl chloride-vinylidene chloride copolymers. It is common practice to use fillers such as calcium carbonate to reduce latex costs. The final step is to apply a secondary backing, generally a woven jute or woven synthetic such as polypropylene onto the primary backing.

In one desired embodiment of the present invention, the method comprises forming forked tri-lobal fibers having a fiber cross-sectional configuration as shown in FIG. 2 by extruding polymer melt through a capillary having a design as shown in FIG. 5. Although the capillary dimensions are not limited in any way (other than to form the forked tri-lobal design), desirably, the capillary has the dimensions as shown in Table 5 below, wherein $A_{orf}$ represents the total area of the capillary, $P_{orf}$ represents the length of the perimeter of the capillary, and $D_{orf}$ represents the diameter of a circle, which completely surrounds the capillary.

TABLE 5

Capillary Dimensions For Forming Exemplary Forked Tri-Lobal Fibers
Capillary Data

| Dimension | Desired Range |
|---|---|
| $A_{orf}$ | about 0.31 to about 0.35 mm |
| $P_{orf}$ | about 7.42 to about 7.50 mm |
| $D_{orf}$ | about 1.53 to about 1.60 mm |

In one desired embodiment, the capillary dimensions are: $A_{orf}$ is 0.33 $mm^2$; $P_{orf}$ is 7.46 mm; and $D_{orf}$ is 1.58 mm.

The resulting fibers from the method described above using the capillary design as shown in FIG. 5 and the dimensions as shown in Table 5 desirably have the following fiber dimensions as shown in Table 6, wherein $A_{fib}$ represents the total area of the fiber, $P_{fib}$ represents the length of the perimeter of the fiber, and $D_{fib}$ represents the diameter of a circle, which completely surrounds the fiber.

TABLE 6

Fiber Dimensions For Exemplary Forked Tri-Lobal Fibers
Fiber Data

| Dimension | Desired Range |
|---|---|
| $A_{fib}$ | about 0.0012 to about 0.0014 $mm^2$ |
| $P_{fib}$ | about 0.2285 to about 0.2362 mm |
| $D_{fib}$ | about 0.046 to about 0.060 mm |

In one desired embodiment, the resulting fiber dimensions are: $A_{fib}$ is 0.0013 $mm^2$; $P_{fib}$ is 0.2324 mm; and $D_{fib}$ is 0.053 mm.

In a further desired embodiment of the present invention, the method, comprises forming serpentine tri-lobal fibers having a fiber cross-sectional configuration as shown in FIG. 3A by extruding polymer melt through a capillary having a design as shown in FIG. 6. Desirably, the capillary has the dimensions as shown in Table 7 below.

TABLE 7

Capillary Dimensions For Forming Exemplary Serpentine Tri-Lobal Fibers
Capillary Data

| Dimension | Desired Range |
|---|---|
| $A_{orf}$ | about 0.24 to about 0.28 $mm^2$ |
| $P_{orf}$ | about 5.79 to about 5.89 mm |
| $D_{orf}$ | about 1.53 to about 1.63 mm |

In one desired embodiment, the capillary dimensions are: $A_{orf}$ is 0.26 $mm^2$; $P_{orf}$ is 5.84 mm; and $D_{orf}$ is 1.58 mm.

The resulting fibers from the method described above using the capillary design as shown in FIG. 6 and the dimensions as shown in Table 7 desirably have the following fiber dimensions as shown in Table 8.

TABLE 8

| Fiber Dimensions For Exemplary Serpentine Tri-Lobal Fibers Fiber Data | |
|---|---|
| Dimension | Desired Range |
| $A_{fib}$ | about 0.0016 to about 0.0018 $mm^2$ |
| $P_{fib}$ | about 0.3027 to about 0.3131 mm |
| $D_{fib}$ | about 0.087 to about 0.090 mm |

In one desired embodiment, the fiber dimensions are: $A_{fib}$ is 0.0017 $mm^2$; $P_{fib}$ is 0.3079 mm; and $D_{fib}$ is 0.088 mm.

In yet a further desired embodiment of the present invention, the method comprises forming elongated S tri-lobal fibers having a fiber cross-sectional configuration as shown in FIG. 3B by extruding polymer melt through a capillary having a design as shown in FIG. 7. Desirably, the capillary has the dimensions as shown in Table 9 below.

TABLE 9

| Capillary Dimensions For Forming Exemplary Elongated S Tri-Lobal Fibers Capillary Data | |
|---|---|
| Dimension | Range |
| $A_{orf}$ | 0.20 to 0.30 $mm^2$ |
| $P_{orf}$ | 4.85 to 5.30 mm |
| $D_{orf}$ | 1.45 to 1.70 mm |

In one desired embodiment, the capillary dimensions are: $A_{orf}$ is 0.24 $mm^2$; $P_{orf}$ is 5.15 mm; and $D_{orf}$ is 1.58 mm.

The resulting fibers form the method described above using the capillary design as shown in FIG. 7 and the dimensions as shown in Table 9 desirably have the following fiber dimensions as shown in Table 10.

TABLE 10

| Fiber Dimensions For Exemplary Elongated S Tri-Lobal Fibers Fiber Data | |
|---|---|
| Dimension | Desired Range |
| $A_{fib}$ | about 0.0017 to about 0.0021 $mm^2$ |
| $P_{fib}$ | about 0.2742 to about 0.2797 mm |
| $D_{fib}$ | about 0.088 to about 0.091 mm |

In one desired embodiment, the fiber dimensions are: $A_{fib}$ is 0.0019 $mm^2$; $P_{fib}$ is 0.2770 mm; and $D_{fib}$ is 0.089 mm.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Preparation of a Nylon Forked Tri-Lobal Fiber and Yarn Containing the Same

Nylon 6 filaments were spun using the capillary design as shown in FIG. 5. Each spinnerette had 12 capillaries of the specific design with the following dimensions:

$A_{orf}$ is 0.3307 $mm^2$;

$P_{orf}$ is 7.4607 mm; and $D_{orf}$ is 1.5760 mm

The angle between lobe-forming portions in the capillary design was 120°.

The nylon 6 polymer (relative viscosity, RV=2.7) was a bright polymer and did not contain any delusterant. The polymer temperature was controlled at the pump block at about 265° C.±0.1° C. and the spinning throughput was 253 g/min per spinnerette.

The molten fibers were quenched in a chimney using 80 ft/min air for cooling the fibers. The filaments were pulled by a feed roll rotating at a surface speed of 865 m/min through the quench zone and coated with a lubricant for drawing and crimping.

The yarns were combined and drawn at 1600 m/min and crimped by a process similar to that described in U.S. Pat. No. 4,095,317 to form a 1100 denier 60 filament yarn.

The spun, drawn, and crimped yarns (BCF) were cable-twisted to a 3.5 turns per inch (tpi) on a cable twister and heat-set on a Superba heat-setting machine at standard conditions for nylon 6 BCF yarns. The yarns were then tufted into a 32 oz/$yd^2$, 3/16 gauge cut pile carpet construction.

The carpet was rated for dullness by an observer panel. The carpet was positioned on the floor and observed for dullness in full sunlight at an angle of about 30° (i.e., the angle of the incoming sunlight to the floor was about 30°). The observer panel rated the carpet "superior" for dullness.

EXAMPLE 2

Preparation of a Nylon Serpentine Tri-lobal Fiber and Yarn Containing the Same Nylon 6 filaments were prepared as described in Example 1 above except a capillary design as shown in FIG. 6 was used. A carpet made therefrom was rated for dullness as described in Example 1. The observer panel rated the carpet "superior" for dullness.

EXAMPLE 3

Preparation of a Nylon Elongated S Tri-lobal Fiber and Yarn Containing the Same Nylon 6 filaments were prepared as described in Example 1 above except a capillary design as shown in FIG. 7 was used. A carpet made therefrom was rated for dullness as described in Example 1. The observer panel rated the carpet "superior" for dullness.

While the specification has been described in detail with respect to specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A fiber comprising two or more lobes extending from a central core, wherein the two or more lobes are equally spaced about an outer periphery of the central core; wherein each lobe has a substantially similar lobal cross-sectional configuration comprising at least three concave portions, at least two convex portions, and at least four inflection points along an outer perimeter of each lobal cross-sectional area, and wherein a maximum distance between adjacent lobes is located between adjacent areas of maximum width of each of said adjacent lobes, and wherein a cross-sectional periphery of said fiber is substantially free of flat surfaces and consists only of said at least three concave portions, said at least two convex portions and said at least four inflection points of each said lobe.

2. The fiber of claim 1, wherein each lobe contains three concave portions, two convex portions, and four inflection points along the outer perimeter of the lobal cross-sectional area; wherein the concave portions, the convex portions, and the inflection points along the outer perimeter of the lobal cross-sectional area forms a symmetrical pathway such that lobe-dissecting line extending from a fiber central axis through a central portion of the lobe dissects the lobe into two substantially identical lobal portions on each side of the lobe-dissecting line.

3. The fiber of claim 2, wherein the fiber has a forked trilobal fiber cross-sectional configuration, wherein each lobe comprises only concave portions, convex portions, and inflection points in a sequence of components comprising a first concave portion, a first inflection point, a first convex portion, a second inflection point, a second concave portion, a third inflection point, a second convex portion, a fourth inflection point, and a third concave portion.

4. The fiber of claim 3 wherein the fiber is substantially free of flat surfaces along an outer perimeter of the forked tri-lobal fiber.

5. The fiber of claim 2, wherein lines extending from inflection points at said areas of maximum width of each of said adjacent lobes are either parallel to one another or divergent relative to one another.

6. The fiber of claim 1 having a fiber cross-sectional area as shown in FIG. 1.

7. The fiber of claim 1, wherein the fiber comprises a polyamide selected from nylon 6 nylon 6/6, nylon 6/9, nylon 6/10, nylon 6/12, nylon 11, nylon 12, and copolymers thereof.

8. The fiber of claim 7 wherein the fiber comprises a monocomponent fiber comprising a single polyamide selected from nylon 6 and nylon 6/6.

9. The fiber of claim 2, wherein the fiber has a fiber core thickness ranging from about 15.0 $\mu$m to about 18.0 $\mu$m, a minimum thickness of lobe component ($t_{min}$) ranging from about 9.0 $\mu$m to about 15.0 $\mu$m, a maximum thickness of lobe component ($t_{max}$) ranging from about 230 $\mu$m to about 350 $\mu$m, and a length of lobe ranging from about 215 $\mu$m to about 335 $\mu$m.

* * * * *